US005711440A

United States Patent [19]

Wada

[11] Patent Number: 5,711,440

[45] Date of Patent: Jan. 27, 1998

[54] SUSPENSION LOAD AND TIPPING MOMENT DETECTING APPARATUS FOR A MOBILE CRANE

[75] Inventor: Minoru Wada, Saitama, Japan

[73] Assignees: Komatsu Ltd.; Komatsu Mec Kabushiki Kaisha, both of Tokyo, Japan

[21] Appl. No.: 640,821

[22] PCT Filed: Nov. 8, 1994

[86] PCT No.: PCT/JP94/01875

§ 371 Date: May 7, 1996

§ 102(e) Date: May 7, 1996

[87] PCT Pub. No.: WO95/13241

PCT Pub. Date: May 18, 1995

[30] Foreign Application Priority Data

Nov. 8, 1993 [JP] Japan ..... 5-302268

[51] Int. Cl.[6] ..... B66C 15/00

[52] U.S. Cl. ..... 212/278; 212/277; 212/300; 212/231

[58] Field of Search ..... 212/277, 278, 212/300, 230, 231, 270

[56] References Cited

U.S. PATENT DOCUMENTS

| | | | |
|---|---|---|---|
| 3,883,130 | 5/1975 | Gardes et al. | 212/278 |
| 4,052,602 | 10/1977 | Horn et al. | 212/278 |
| 4,178,591 | 12/1979 | Geppert | 212/278 |
| 4,241,837 | 12/1980 | Suverkrop | 212/231 |
| 4,752,012 | 6/1988 | Juergens | 212/277 |

FOREIGN PATENT DOCUMENTS

| | | |
|---|---|---|
| 58-30684 | 8/1981 | Japan . |
| 57-3792 | 1/1982 | Japan . |
| 63-39518 | 8/1988 | Japan . |
| 63-154600 | 10/1988 | Japan . |
| 3-23480 | 3/1991 | Japan . |

*Primary Examiner*—Thomas J. Brahan
*Attorney, Agent, or Firm*—Sidley & Austin

[57] ABSTRACT

The present invention relates to a suspension load and tipping moment calculating apparatus for a mobile crane which can calculate a suspension load and a tipping moment with high accuracy and use an excessive load prevention load while ensuring safety. For this reason, the apparatus is provided with sensors (50, 48, 46) for detecting a boom length, a boom angle, and an axle weight of a boom derricking cylinder (26) on a second boom (28) side, and is equipped with a controller (38) for calculating a suspension load (Wa) suspended from the second boom (28) based on signals from these sensors. In addition, for calculating a tipping moment, a boom length sensor (44) and a boom angle sensor (42) on a first boom (24) side are provided.

26 Claims, 5 Drawing Sheets

SUSPENSION LOAD AND TIPPING MOMENT DETECTING APPARATUS FOR A MOBILE CRANE

TECHNICAL FIELD

The present invention relates to a suspension load and tipping moment detecting apparatus for a mobile crane, and more particularly, to a suspension load and tipping moment determining apparatus for a mobile crane capable of reducing an error produced at the time of calculating a suspension load and a tipping moment.

BACKGROUND ART

In a conventional mobile crane, a telescopic boom is mounted to a chassis so that the boom can turn and can swing upwardly and downwardly, and the boom is pointed to a predetermined direction by a turning motor and is raised by a derricking cylinder to a state in which it stands substantially upright. A jib of a truss construction type is mounted to the tip of the telescopic boom, and heavy equipment is lifted and moved by a suspension hook which is moved upwardly and downwardly from the tip of the jib. In contrast with such mobile crane, a crane truck has been recently proposed in which a telescopic boom is mounted in place of the jib so as to impart a function of a tower crane thereto. According to such crane truck, a first boom, raised in a substantially upright state on a turn table of a chassis by the derricking cylinder, is extended to a desired height; a second boom, mounted to the tip of the first boom, is extended while being set to a substantially horizontal state by its own derricking cylinder; and the suspension hook hanging from the tip of the second boom is lowered toward the ground so as to perform operations.

Incidentally, according to the mobile crane to which a function of the tower crane is imparted, since the second boom is horizontally extended at a high lift position, it is important to determine a suspension load and a tipping moment associated therewith from a viewpoint of a safety operation so as to prevent an excessive load. For this type of excessive load prevention, a suspension load has been conventionally calculated from a balance equation of a moment due to the suspension load, a boom self-weight, and a resistance moment due to an axle weight applied to the derricking cylinder of the first boom, and the value thereof has been determined so as to calculate the tipping moment.

However, according to the conventional method, the suspension load and the tipping moment are calculated from the axle weight applied to a main cylinder which derricks the first boom. Thus, in the event that the first boom is operated to increase a tilt angle from the vertical position thereof so that operating radius is increased, the effect of the piston frictional force within the main cylinder on the axle weight is increased, whereby a value smaller than the actual suspension load may be outputted. More particularly, in the event that the second boom is extended, the effect of the frictional force cannot be ignored because the position of the center of gravity of the entire boom moves farther away from a base point of the main cylinder. For this reason, according to a conventional excessive load prevention system, a safety factor is forced to be set high so as to be determined on the side of safety, and therefore, there is a drawback in that the system can be operated only within a range which is smaller than the actually possible operation range. In addition, when calculating the tipping moment, the conventional system is one in which the operating radius is calculated by a geometrical operation in which a boom is a rigid body, although the boom is deflected by the suspension load and the self-weight thereof. Thus, there is a problem in that the actual operating radius is not reflected to the excessive load prevention system correctly.

SUMMARY OF THE INVENTION

The present invention has been made to solve the drawbacks of the prior art, and particularly has its object to provide a suspension load and tipping moment determining apparatus for a mobile crane capable of determining the suspension load and the tipping moment with high accuracy, thereby making effective use of an excessive load prevention system while ensuring safety.

A suspension load determining apparatus for a mobile crane according to the present invention is provided with sensors for detecting a boom length, a boom angle, and an axle weight of a boom derricking cylinder on a second boon side, is provided with sensors for detecting a boom length, a boom angle, and an axle weight of a boom derricking cylinder on a first boom side, and is equipped with a controller for calculating the suspension load suspended from the second boom based on signals form these sensors on the second boom side, for calculating the suspension load based on signals from these sensors on the first boom side, and for comparing the calculated value on the second boom side with the calculated value on the first boom side to output the larger value of the calculated suspension load as a determined suspension load.

According to such a construction, each suspension load is determined by the same technique as in the conventional one, from an axle weight applied to the derricking cylinder of the first boom, and from an axle weight applied to the derricking cylinder of the second boom, both of the suspension loads are compared, and the value on the safety side is outputted as the determined suspension load. By this, even if abnormal values are determined due to a failure or the like, one acts as a backup, thereby imparting a high safety.

In addition, in a suspension load determining apparatus for a mobile crane according to the present invention, the above-described controller can be provided with a correction processing unit for correcting the axle weight with a frictional force of the boom derricking cylinder of each boom.

According to such a construction, since the detected axle weight is corrected with the frictional force of the boom cylinders at the time of determining these suspension loads, it becomes possible to determine the suspension load with high accuracy.

In addition, a tipping moment determining apparatus for a mobile crane according to the present invention is provided with sensors for detecting a boom length, a boom angle, and an axle weight of a boom derricking cylinder on a second boom side, is provided with sensors for detecting a boom length, a boom angle, and an axile weight of a boom derricking cylinder on a first boom side, and is equipped with a controller for calculating the suspension load suspended from the second boom based on signals from these sensors on the second boom side, for calculating the suspension load based on signals from these sensors on the first boom side, and for comparing the calculated value on the second boom side with the calculated value on the first boom side to output the larger value of the suspension load as a determined suspension load, wherein this controller calculates operating radii of the first boom and the second boom by signals from the boom length sensors and the boom angle sensors on each of the boom sides so as to output a tipping moment from the calculated suspension load and the calculated operating radii.

According to such a construction, by using the larger value of the suspension load between the value calculated on the boom derricking cylinder side of the second boom and the value calculated on the boom derricking cylinder side of the first boom, and multiplying that value by the operating radii due to the overhanging of the booms, the tipping moment on the safety side can be always calculated. Therefore, even if a failure or the like occurs in one of the suspension load calculating functions, there is a backup function and safety is improved.

BRIEF DESCRIPTION OF DRAWINGS

FIGS. 4A and 4B are views for calculating boom deflection of the embodiment, in which FIG. 4A is an explanatory view of a first boom, and FIG. 4B is an explanatory view of a second boom 28.

BEST MODE FOR CARRYING OUT THE INVENTION

The preferred embodiments of suspension load and tipping moment determining apparatuses for a mobile crane according to the present invention will now be described in detail with reference to the attached drawings.

Figure 1:
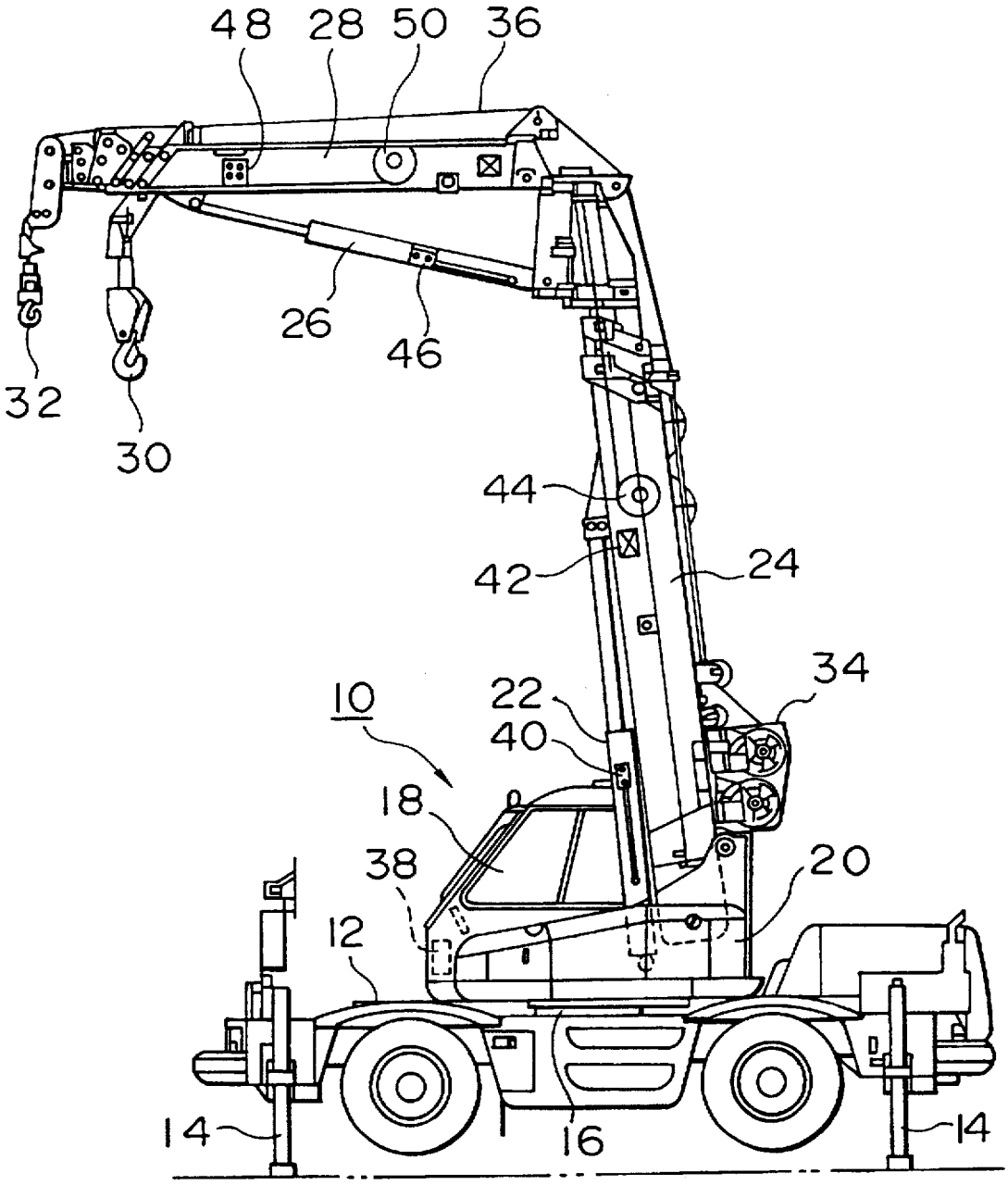
FIG. 1 is a side view of a mobile crane equipped with a suspension load and tipping moment determining apparatus according to the present invention.

FIG. 1 is a side view of a mobile crane 10 according to the present invention. The mobile crane 10 has a chassis 12 which can travel by means of wheels; and outriggers 14, which can overhang right and left, are provided in front of and behind the chassis 12 so as to suspend and hold stably the chassis 12. In the center portion of the chassis 12, a cab 18 and a boom base 20 are mounted on a turntable 16, and a crane boom means is mounted with respect to the boom base 20. The crane boom means comprises a first boom 24, which is mounted vertically swingably on the base 20 by a derricking cylinder 26, and a second boom 28, which is mounted to the tip of the first boom 24 in such a manner that it can extend horizontally and which is vertically swingable due to a derricking cylinder 26, provided between the first boom 24 and the second boom 28. Each of these booms 24 and 28 is a multi-stage boom having a telescopic structure so as to be extendable; the first boom 24 functions as a vertical boom which is extendable to a desired height, and the second boom 28 functions as a horizontal boom which is extendable in a substantially horizontal direction. In the event that the second boom 28 is set to the minimum length, the mobile crane 10 can be used as a normal crane, and by extending the second boom 28, the mobile crane 10 can be used as a tower crane. For the normal crane function, a main hook 30 is disposed on the tip of a base end boom portion of the second boom 28, and for the tower crane function, an auxiliary hook 32 is disposed on the tip boom portion of the second boom 28. These hooks are moved upwardly and downwardly by a cable 36 paid out of a winch 34, mounted on the base portion side of the first boom 24.

The mobile crane 10, constructed as described above, is equipped with a controller 38 for determining a suspension load and a tipping moment. This performs an operation of mainly detecting an axle weight due to a derricking cylinder (hereinafter, referred to as a second cylinder) 26 of the second boom 28 in addition to an operation of mainly detecting an axle weight due to a derricking cylinder (hereinafter, referred to as a first cylinder) 22 of the first boom 24. For these operations, an axle weight sensor 40 for detecting an axle weight of the first cylinder 22, a boom angle detecting sensor 42, and a length sensor 44 for detecting the length of the first boom 24 are provided on the first boom 24 side. According to the present invention, particularly, a second axle weight sensor 46 for detecting an axle weight of the second cylinder 26, a second boom angle detecting sensor 48, and a second length sensor 50 for detecting the length of the second boom 28 are provided on the second boom 28 side separately and distinctly from the above sensors. The controller 38 inputs the detected signals from each of these sensors, and calculates a suspension load mainly from the detected signals from the sensors 46, 48 and 50 attached to the second boom 28, and calculates a backup suspension load mainly by the detected signals due to the sensors 40, 42 and 44 attached to the first boom 24.

Figure 2:
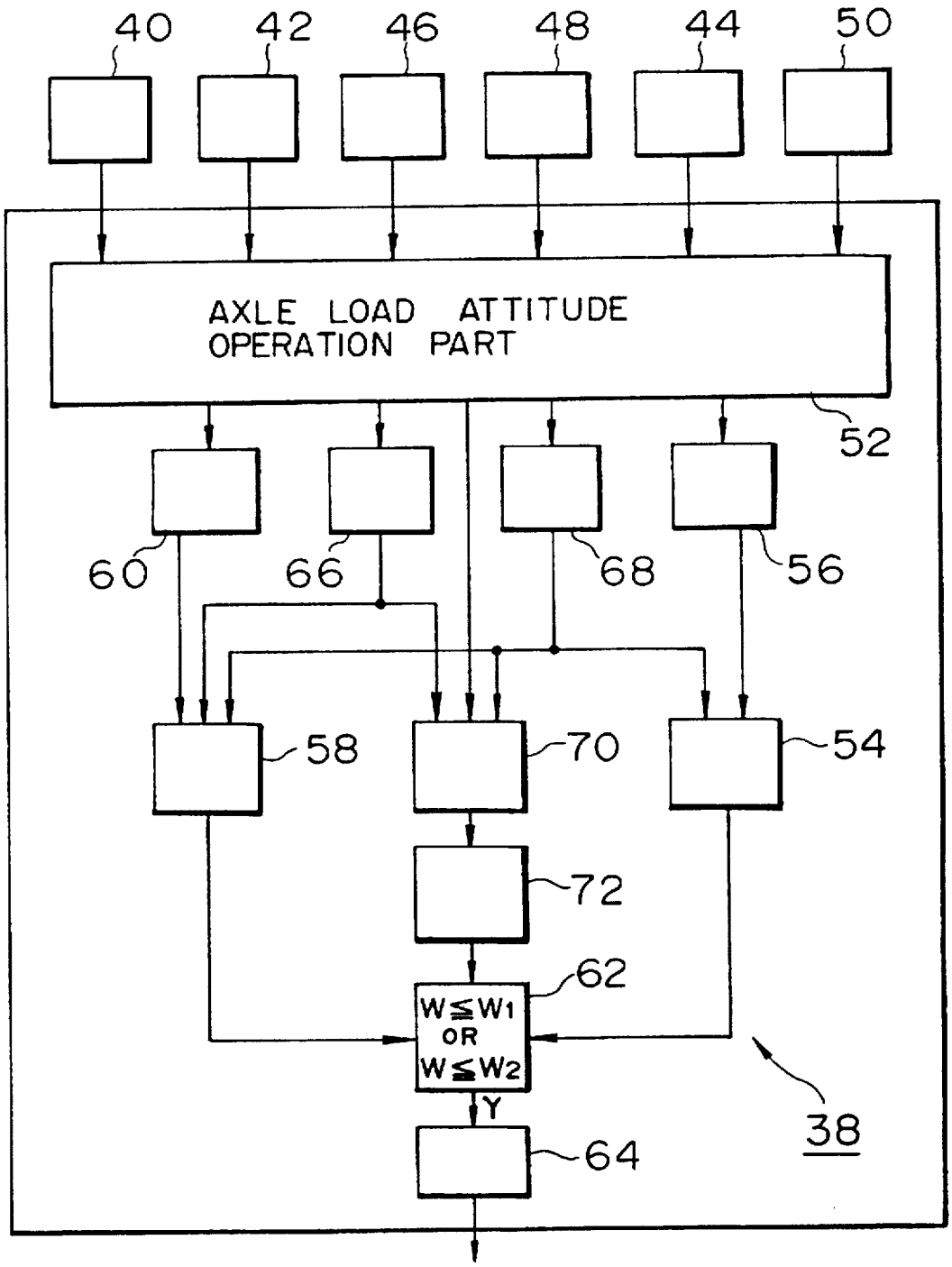
FIG. 2 is a block diagram showing a configuration of a controller of a suspension load and tipping moment determining apparatus according to an embodiment.

The controller 38, as shown in FIG. 2, inputs the signals from the above sensors and takes t-he same into an axle load.attitude calculation unit 52. In this calculation unit, the axle loads applied to the first boom 24 and the second boom 28 are multiplied by the boom tilt angles. The axle weights are determined by first and second axle weight sensors 40 and 46, and the tilt angles are determined by first and second boom angle detecting sensors 42 and 48. As the axle weight sensors 40 and 46, sensors which detect and convert oil pressures, applied to the derricking cylinders 22 and 26, into voltage signals can be used, or a load cell established on a load point of a cylinder rocking support point can be used. As boom angle detecting sensors 42 and 48, sensors can be used which are comprised of a combination of a pendulum and a potentiometer, and sensors may be used which output a boom derricking angle with respect to a horizontal angle as an electric signal. Therefore, the axle weights and the boom attitudes at each of the first and second booms 24 and 28 can be obtained.

Figure 3:
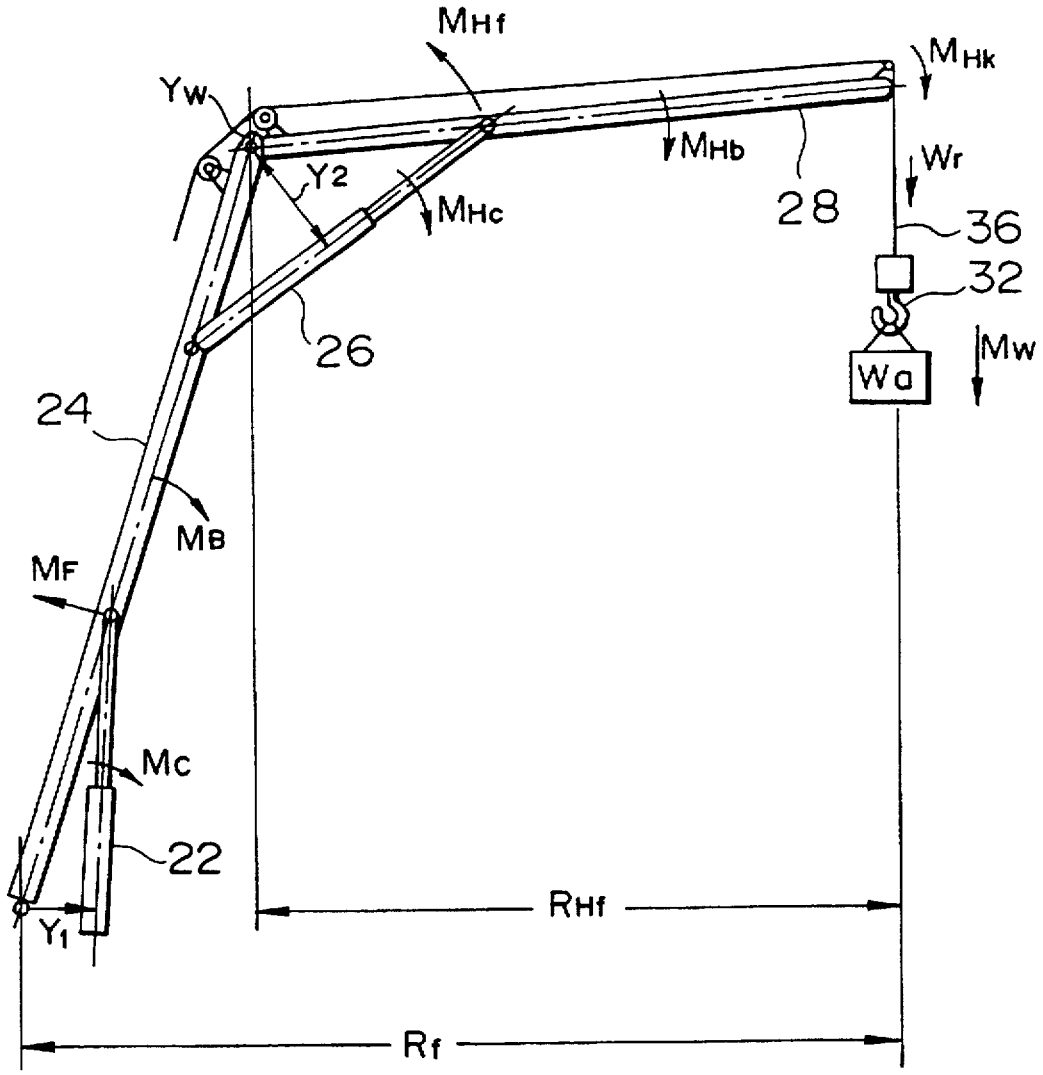
FIG. 3 is an explanatory view of each acting force for determining a suspension load and tipping load of the embodiment.

A method for calculating a suspension load on the second boom 28 side will now be described using a schematic diagram of FIG. 3. A moment balance equation about a foot pin (connecting point to the first boom 24) of the second boom 28-is considered. In the first place, a rotation moment on the tipping side due to a suspension load Wa includes a self-weight moment MHb of the second boom 28, a self-weight moment MHc of the second derricking cylinder 26, a self-weight moment MHk of the auxiliary hook 32, a moment Mw [=RHf×(Wa+Wr): RHf is a horizontal distance to the suspension load] due to the suspension load Wa and a weight Wr of the cable 36. A moment which resists them includes a reaction force moment MHf due to the second cylinder 26 and a cable tension moment MHw due to the winch means 34. Letting a detected axial force be FH and a cylinder distance from the foot pin of the second boom 28 be Y2, the cylinder reaction force moment MHf can be determined by the equation MHf=FH×Y2. In addition, the cable tension moment MHw can be determined by the equation MHw=Yw×(Wa+Wr)/N, letting a distance from the foot pin to the cable 36 be Yw, because the tension is the sum of the suspension load Wa and the cable weight Wr, divided by the number of falls (number of windings around a sheave) N.

For this reason, the suspension load Wa can be determined by the following equation (1):

$$Wa=(MHf-MHb-MHc-MHk)(RHf-Yw/N)-Wr \quad (1)$$

Here, the cylinder reaction force moment MHf is a product of the detected axial force FH and the cylinder distance Y2, and can be calculated from the size and the boom angle of the cylinder 26. The boom self-weight moment MHb can be calculated by detecting the position of the center of gravity, varying with the boom overhang length, with the second boom length sensor 50, defining beforehand the relationship between the position of the center of gravity and each overhang length, calculating the position of the center of gravity therefrom, and multiplying the same by a boom weight defined from a design viewpoint. The cylinder self-weight moment MHc can be determined as the moment corresponding to a stroke based on the cylinder size and oil weight. Furthermore, the hook moment MHk can be easily calculated from the hook weight and the boom overhang length. Moreover, the distance RHf to a suspension cargo and the distance Yw between the foot pin and the cable are easily calculated from a design geometrical relation construction, and the cable weight Wr can by determined by multiplying a feeding length from the boom tip by a unit weight.

Thus, the controller 38 is equipped with a load calculation unit 54 for storing beforehand each data required for the calculation of the suspension load Wa, reading in the corresponding data together with values detected from the sensors and calculating the suspension load based on the above equation (1). Therefore, on the second cylinder 26 side, output signals from the axle load.attitude calculation unit 52 which inputs signals from the second axle weight sensor 46 and the second boom angle detecting sensor 48, and detection signals from the second length sensor 50 are inputted here, and data required for the operation of the equation (1) are read in to output the suspension load Wa as an operation result.

Incidentally, an inner frictional force at the second cylinder 26 influences the axle load outputted from the axle load.attitude operation part 52. That is, the second cylinder 26 rarely operates only in a vertical direction, and therefore, a frictional force is generated between an integrated piston and a cylinder tube to cause an error to the axle weight detected by the sensor 46. Thus, in this embodiment, output signals from the axle load.attitude calculation unit 52 are adjusted by a frictional force correction unit 56 before being sent to a load calculation unit 54. The error We (true load–calculated value) of the suspension load can be approximately determined using the following equation (2) as a multiple regression equation in which the first boom length is taken as L, the first boom angle is taken as θ, and the first cylinder axial force is taken as F. Therefore, the error We of the suspension load can be determined by the following equation (2):

$$We=L\times C1+\theta\times C\theta+F\times Cf+CO \quad (2)$$

Each value C in this equation is stored beforehand in a memory as a table, and selectively used in accordance with an operation mode to calculate the error We. Then, the error we is corrected and outputted to the above load calculation unit 54, the suspension load is calculated based on the equation (1) with the axle weight corrected by the frictional force in the load calculation unit 54, and the suspension load is outputted as a determined suspension load W2.

Since the above determination is performed on the second boom 28 side, an error generating cause such as an action due to the self-weight of the first boom 24 is not included in the calculated value, thus exhibiting very high accuracy. In this embodiment, however, in order to provide a back-up in the event of a generation of failure of the calculation unit, the suspension load is also calculated with the similar technique from the detected axial force at the derricking cylinder 22 on the first boom 24 side. When a moment MB, due to the self-weight of the first boom 24, and a moment MC, due to the self-weight of the first cylinder 22, are considered in addition to the above equation (1), the suspension load Wam on the first cylinder 22 side can be determined by the following equation (3):

$$Wam=(MF-MHb-MHc-MHk-MB-Mc)/Rf-Wr \quad (3)$$

in which Rf is a horizontal distance from the foot pin of the first boom 24 to the suspension load position. MF is a product of the detected axial force F and the cylinder distance Y1, which can be calculated from the size and the boom angle of the cylinder 22. The moment MB, due to the selfweight of the first boom 24, and the moment MC, due to the self-weight of the first cylinder 22, can be determined similarly to the description of the equation (1), and the boom self-weight moment MB can be determined by determining the position of the center of gravity, varying with the boom overhang length, with the first boom length sensor 44, defining beforehand the relationship between the position of the center of gravity and each overhang length, calculating the position of the center of gravity therefrom, and multiplying the same by a boom weight defined from a design viewpoint. The cylinder self-weight moment Mc can be calculated as a moment corresponding to a stroke based on the cylinder size and the oil weight. Others are calculated by a calculation method similar to that of the equation (1).

Then, the suspension load Wam is determined in the load calculation unit 58 from the axle weight detection due to the first cylinder 22. In this case, however, a frictional force in the first cylinder 22 is also corrected. For this purpose, a frictional force correction unit 60 is provided for inputting the output signals from the axle load.attitude calculation unit 52 prior to the above suspension load calculation unit 58. In the frictional force correction unit 60, a calculation method similar to that for the second cylinder 26 is adopted, and the error We (true load calculated value) of the suspension load is approximately determined using the above equation (2) as a multiple regression equation in which the first boom length is taken as L, the first boom angle is taken as θ, and the first cylinder axial force is taken as F. In this case, each value C is also stored beforehand in a memory as a table, and selectively used in accordance with an operation mode to calculate the error We. Then, the error We is corrected and outputted to the above load calculation unit 58, the suspension load is calculated based on the equation (3) with the axle weight corrected by the frictional force in the load calculation unit 54, and the resultant suspension load is outputted as a calculated suspension load W1.

The operated suspension load W1 in which the frictional force is considered in the first cylinder 22 and the operated suspension load W2 in which the frictional force is considered in the second cylinder 26 are outputted. In the embodiment, however, the larger value of the outputted loads W1 and W2 is outputted as the determined suspension load. For this purpose, the controller 38 is equipped with a comparator 62, and each of the calculated suspension loads W1 and W2 are inputted thereto and compared with a reference suspension load W so as to excite seizing signals in an automatic stop signal generator 64 when either of the two values exceeds the reference load W.

Therefore, in the embodiment, the axle weight applied to the first cylinder 22 and the second cylinder 26 are employed in the calculation after performing a frictional force correction processing, and the necessary data are read in from the memory based on the corrected axle loads, and then each of the suspension loads are calculated by the equations (1) and (3). In addition, since a crane operation is automatically stopped when a comparison with the reference load W indicates that the calculated suspension load exceeds the reference value, a system with extremely high safety can be provided.

Incidentally, according to the controller 38, the reference load W inputted to the above comparator 62 is determined from the tipping moment, and for this purpose, operating radii R are determined by detected signals from the boom angle sensors 42 and 48, and from the length sensors 44 and 50 of each of the booms 24 and 28. Boom overhang lengths are basically obtained by the length sensors 44 and 50, and the horizontal distances due to the first and second booms 24 and 28 are determined by a product of cosine values of the angles detected by the angle sensors 42 and 48. (Of course, when there is a deviation between the foot pin of the first boom 24 and the foot pin of the second boom 28 in a direction perpendicular to the extending direction of the first boom 24, the deviation should be considered and calculated. The same can be said with respect to the second boom 28.) Therefore, by subtracting a distance between a center line of rotation and the foot pin of the first boom 22 from the horizontal distance Rf, the operating radii R can be calculated.

Figure 4A:
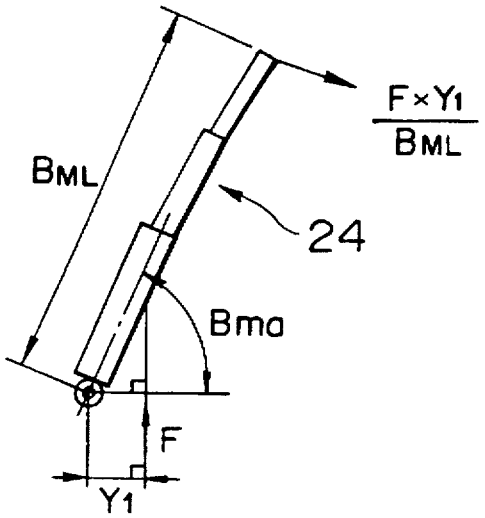

In this case, a deflection of the boom, which is generated by the boom self-weight and the suspension cargo, influences the operating radii. The deflection usually increases the operating radii and the tipping moment. Thus, according to the embodiment, the boom lengths detected by the length sensors 44 and 50 are separately corrected for the deflections of the first and second booms 24 and 28. That is, in the deflection correction processing unit 66 on the first boom 24 side, the self-weight due to the second boom 28 is treated as an increment of the suspension load, and the first boom self-weight, suspension load, and horizontal boom self-weight are determined as an addition of a force F×Y1/BML which is equivalently converted so as to be applied in a direction perpendicular to the first boom at the tip of the first boom 24 (See FIG. 4A). A numerator is a supporting moment at the first boom 24. If the deflection DXM of the first boom 24 is approximately proportional to the equivalent conversion force, the following equation (4) holds.

$$DXM=KM\times(F\times Y1/BML) \quad (4)$$

in which KM represents an elastic coefficient of an extension of the boom. Letting the deflection toward the operating radii be DRM with use of the thus calculated deflection DXM, DRM can be determined by the following equation (5):

$$DRM=DXM\times SIN\ (Bma) \quad (5)$$

Bma is a derricking angle of the first boom 24. Therefore, the first deflection correction processing unit 66 inputs therein the axle weight F applied to the first cylinder 22 and the signal BML from the length sensor 44 of the first boom 24, inputs Bma from the angle signal from the boom angle detecting sensor 42, and calculates Y1 to perform the above operation.

Figure 5A:
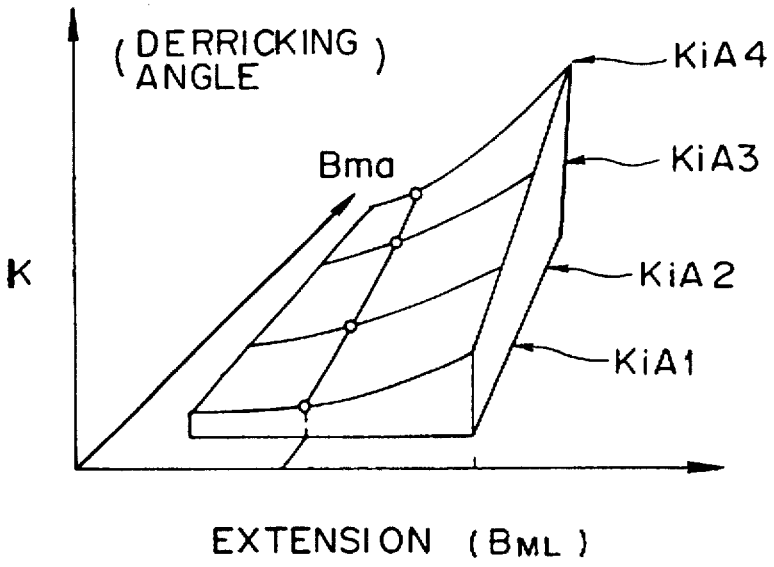
FIGS. 5A and 5B are explanatory views of a boom elastic coefficient for calculating the boom deflections of the embodiment.
Figure 5B:
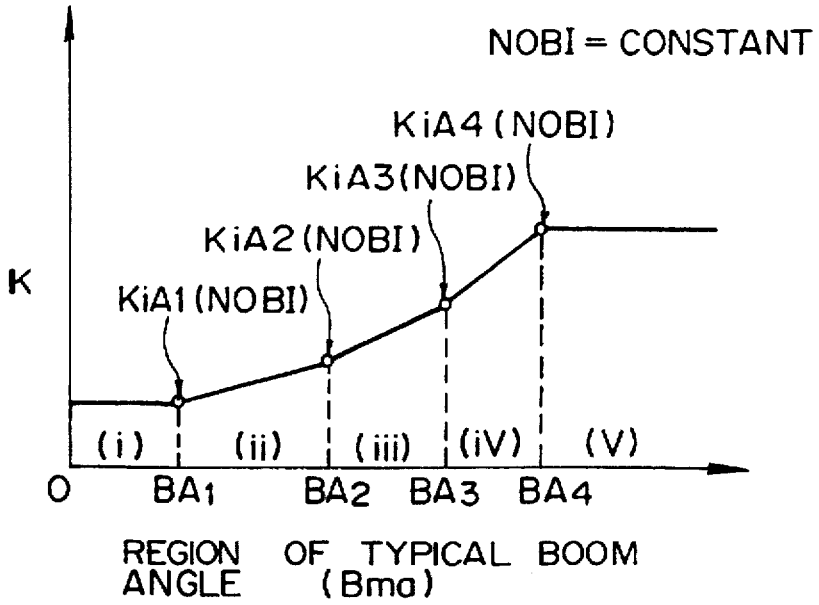

The boom elastic coefficient KM is determined as follows. Since the elastic coefficient varies with operating conditions (setting of operating machines and setting of the outriggers), the boom extension BML, the derricking angle Bma, and the suspension load are varied at each working condition to determine data. And, the boom elastic coefficient is counted back as an ideal deflection coefficient based on the measured actual operating radii and the sensor input values at that time. And then, a boom derricking angle region is divided into a plurality of groups, and a statistical calculation is performed in each group using data around a typical derricking angle. The statistical calculation performs a least square approximation due to a cubic expression between the extension and the above counted back deflection correction coefficient to calculate the deflection correction coefficient Km to each of the above derricking angle regions. This state is shown in FIGS. 5A and 5B. Among each of the regions, the boom elastic coefficient can be calculated by interpolation.

For the actual operation, the operating conditions are labeled, the boom elastic coefficient KM is calculated beforehand according to the boom derricking angle and the boom extension and is stored in the memory at each label, the elastic coefficient KM satisfying the condition given by the detection from each sensor is read out, and operation with the above equations (4) and (5) can be performed in the deflection correction processing unit 66 to perform an interpolating operation.

Figure 4B:
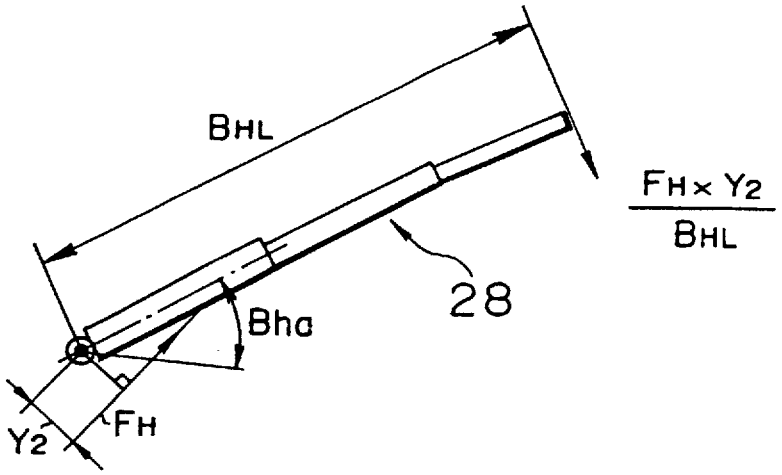

In addition, a boom deflection is generated in the second boom 28 by the suspension cargo. Thus, in a deflection correction processing unit 68 on the second boom 28 side, since not only the suspension load but also the self-weight of the second boom 28 are referred to, the second boom self-weight and the suspension load are determined as an addition of a force FH×Y2/BHL which is equivalently converted so as to be applied in a direction perpendicular to the second boom at the tip of the second boom 28 (see FIG. 4B). A numerator is a supporting moment at the second boom 28. If the deflection DXH of the first boom 24 is approximately proportional to the equivalent conversion force, the following equation holds.

$$DXH=KH\times(FH\times Y2/BHL)$$

in which KH represents an elastic coefficient of an extension of the second boom. Letting the deflection toward the operating radii be DRH with use of the thus calculated deflection DXH, DRH can be determined by the following equation:

$$DRH=DXH\times SIN\ (Bha)$$

Bha is a derricking angle of the second boom 28. Therefore, the second deflection correction processing unit 68 inputs therein the axle weight FH applied to the second cylinder 26 and the signal BHL from the length sensor 50 of the second boom 28, inputs Bha from the angle signal from the boom angle detecting sensor 48, and calculates Y2 to perform the above operation. The boom elastic coefficient KH can be determined as in the case of the above first boom 24 (see FIGS. 5A and 5B).

When the amounts of deflections of each of the first and second booms 24 and 28 are calculated in the correction processing units 66 and 68, they are outputted to an operating radius calculation unit 70 and a deflection portion is added to the value of the boom length, and then a distance between a center line of rotation of the turntable 16 and the foot pin of the first boom 24 is subtracted, so that the actual operating radii from the center line of rotation are calculated. The actual operating radii are used for calculating a crane tipping moment so as to calculate a critical load w in the above operating radii from the calculated moment value. A critical load operation unit 72, therefore, inputs therein selectively the above calculated actual operating radii, the stored outrigger state, and an optimum constant from a constant table, and operates and outputs the critical load W with a predetermined rated load calculating expression. As the rated load calculating expression, a known method can be adopted. The calculated critical load W is outputted to the above-described comparator 62 and used as the reference value W for comparison with the calculated suspension loads W1 and W2 which are independently calculated on the first cylinder 22 side and the second cylinder 26 side, respectively.

As a result, according to this embodiment, the suspension load can be calculated mainly from the axle weight acting on the derricking cylinder 26 on the second boom 28 side, whereby a friction at the derricking cylinder on the first boom 24 side and an influence due to the first boom self-weight can be prevented as much as possible from mixing into the load calculated value and generating errors. Therefore, detection of the suspension load with high accuracy can be achieved. In addition, the suspension load due to the axle weight at the first derricking cylinder 22 is calculated simultaneously to be used as a backup, and from a viewpoint of operation, a dangerous load is judged by the comparison of the calculated value on the above second cylinder 26 side. Thus, a misjudgment due to a failure of the calculation unit can be prevented. In any event, since the frictional forces within the first and second cylinders 22 and 26 are corrected when calculating the suspension load, a suspension load calculating apparatus with sufficiently higher accuracy than ever is provided.

In addition, the basic operating radii are calculated by the angle boom lengths and derricking angles of the first boom 24 and the second boom 28 when calculating the tipping moment. At this time, however, the deflections of each of the booms 24 and 28 cannot be ignored. According to this embodiment, the deflection is calculated at each boom and added to the boom measured length. Since the critical load can be calculated based on this in relation to the rated load, the critical load is prevented from being apparently increased by the deflections of the booms 24 and 28 so as to be set bigger than it really is, whereby the calculation accuracy is further increased and safety is improved.

As described above, according to the present invention, since the suspension load is suitably corrected in consideration of the cylinder frictional force while detecting the axle weight acting on the derricking cylinder of the second boom which functions as a horizontal boom, the suspension load is calculated accurately. And, by using the suspension load calculated value from the axle weight acting on the first boom, which functions as a vertical boom, as a backup as needed, a suspension load calculating apparatus having higher safety can be provided. In addition, the operating radii are determined from the overhang length and the derricking angle of each boom. At this time, by adding the deflection amount of each boom, the exact operating radii are determined. The actual tipping moment can be determined exactly with the operating radii and the above accurate and safe suspension load, and the critical load obtained thereby becomes a suitable value. Therefore, even if the critical value is used as the reference load when comparing with the calculated suspension load, it is judged in safety, thereby providing an effect of effectively using an excessive load prevention system.

INDUSTRIAL APPLICABILITY

The present invention is useful as a suspension load and tipping moment detecting apparatus for a mobile crane, thereby making effective use of an excessive load prevention system while ensuring safety.

I claim:

1. A method of operating a mobile crane, wherein said mobile crane comprises a chassis, a first boom having a first end and a second end, said first end being pivotally mounted to said chassis, a first derricking cylinder connected to said first boom for swinging said second end of said first boom vertically with respect to said chassis, a second boom having a first end and a second end, the first end of said second boom being pivotally connected to said second end of said first boom, and a second derricking cylinder connected between said first boom and said second boom for vertically swinging said second boom with respect to said first boom, wherein said method comprises the steps of:

determining a boom length of said first boom, determining a boom angle of said first boom, determining an axle weight on said first derricking cylinder, determining a boom length of said second boom, determining a boom angle of said second boom, determining an axle weight on said second derricking cylinder, calculating a first suspension load for said first boom based on the thus determined boom length of said first boom, the thus determined boom angle of said first boom, and the thus determined axle weight on said first derricking cylinder, calculating a second suspension load for said second boom based on the thus determined boom length of said second boom, the thus determined boom angle of said second boom, and the thus determined axle weight on said second derricking cylinder, comparing the thus calculated first suspension load with the thus calculated second suspension load, and outputting the larger of said first calculated suspension load and said second calculated suspension load as a determined suspension load.

2. A method in accordance with claim 1, further comprising correcting the thus determined axle weight on said second derricking cylinder for a frictional force within said second derricking cylinder, and wherein said step of calculating said second suspension load for said second boom comprises calculating said second suspension load based on the thus determined boom length of said second boom, the thus determined boom angle of said second boom, and the thus corrected axle weight on said second derricking cylinder.

3. A method in accordance with claim 1, further comprising correcting the thus determined axle weight on said first derricking cylinder for a frictional force within said first derricking cylinder, and wherein said step of calculating said first suspension load for said first boom comprises calculating said first suspension load based on the thus determined boom length of said first boom, the thus determined boom angle of said first boom, and the thus corrected axle weight on said first derricking cylinder.

4. A method in accordance with claim 1, further comprising calculating operating radii of said first boom and of said second boom and outputting a tipping moment signal based on said determined suspension load and the thus calculated operating radii.

5. A method in accordance with claim 4, further comprising calculating a deflection amount of said first boom and correcting said operating radii by said deflection amount, and wherein said step of outputting a tipping moment signal is based on said determined suspension load and the thus corrected operating radii.

6. A method in accordance with claim 1, further comprising determining a reference load, comparing each of said first and second calculated suspension loads with said reference load, and automatically stopping an operation of said crane when either of said first and second calculated suspension loads exceeds said reference load.

7. A mobile crane comprising:

a chassis, a first boom having a first end and a second end, said first end being pivotally mounted to said chassis, a first derricking cylinder connected to said first boom for swinging said second end of said first boom vertically with respect to said chassis, a second boom having a first end and a second end, the first end of said second boom being pivotally connected to said second end of said first boom, a second derricking cylinder connected between said first boom and said second boom for vertically swinging said second boom with respect to said first boom, a first sensor for detecting a boom length of said first boom, a second sensor for detecting a boom angle of said first boom, a third sensor for detecting an axle weight on said first derricking cylinder, a fourth sensor for detecting a boom length of said second boom, a fifth sensor for detecting a boom angle of said second boom, a sixth sensor for detecting an axle weight on said second derricking cylinder, a controller for receiving signals from said first, second, and third sensors and calculating a first suspension load for said first boom based on the signals received from said first, second, and third sensors, for receiving signals from said fourth, fifth, and sixth sensors and calculating a second suspension load for said second boom based on the signals received from said fourth, fifth, and sixth sensors, for comparing the thus calculated first suspension load with the thus calculated second suspension load, and for outputting the larger of said first calculated suspension load and said second calculated suspension load as a determined suspension load.

8. A mobile crane in accordance with claim 7, wherein said controller is provided with a correction processing unit for correcting the thus detected axle weight on said second derricking cylinder for a frictional force within said second derricking cylinder, and wherein said controller calculates said second suspension load for said second boom based on the signals received from said fourth and fifth sensors and the thus corrected axle weight on said second derricking cylinder.

9. A mobile crane in accordance with claim 7, wherein said controller is provided with a first correction processing unit for correcting the thus detected axle weight on said first derricking cylinder for a frictional force within said first derricking cylinder, and wherein said controller calculates said first suspension load for said first boom based on the signals received from said first and second sensors and the thus corrected axle weight on said first derricking cylinder.

10. A mobile crane in accordance with claim 9, wherein said controller is provided with a second correction processing unit for correcting the thus detected axle weight on said second derricking cylinder for a frictional force within said second derricking cylinder, and wherein said controller calculates said second suspension load for said second boom based on the signals received from said fourth and fifth sensors and the thus corrected axle weight on said second derricking cylinder.

11. A mobile crane in accordance with claim 10, wherein said controller calculates operating radii of said first boom and of said second boom based on the signals received from said first and second sensors and outputs a tipping moment signal based on said determined suspension load and the thus calculated operating radii.

12. A mobile crane in accordance with claim 11, wherein said controller is equipped with a correction processing unit for calculating a deflection amount of said first boom and for correcting said operating radii by said deflection amount, and wherein said tipping moment signal is based on said determined suspension load and the thus corrected operating radii.

13. A mobile crane in accordance with claim 12, wherein each of said first and second booms is a telescoping boom.

14. A mobile crane in accordance with claim 13, wherein said controller provides a reference load, compares each of said first and second calculated suspension loads with said reference load, and automatically stops an operation of said crane when either of said first and second calculated suspension loads exceeds said reference load.

15. A mobile crane in accordance with claim 7, wherein said controller calculates operating radii of said first boom and of said second boom based on the signals received from said first and second sensors and outputs a tipping moment signal based on said determined suspension load and the thus calculated operating radii.

16. A mobile crane in accordance with claim 15, wherein said controller is equipped with a correction processing unit for calculating a deflection amount of said first boom and for correcting said operating radii by said deflection amount, and wherein said tipping moment signal is based on said determined suspension load and the thus corrected operating radii.

17. A mobile crane in accordance with claim 15, wherein said controller is equipped with a correction processing unit for calculating a deflection amount of said first boom and a deflection amount of said second boom and for correcting said operating radii by said deflection amounts, and wherein said tipping moment signal is based on said determined suspension load and the thus corrected operating radii.

18. A mobile crane in accordance with claim 17, wherein said controller provides a reference load, compares each of said first and second calculated suspension loads with said reference load, and automatically stops an operation of said crane when either of said first and second calculated suspension loads exceeds said reference load.

19. A mobile crane in accordance with claim 18, wherein each of said first and second booms is a telescoping boom.

20. A mobile crane in accordance with claim 7, wherein said controller calculates operating radii of said first boom and of said second boom based on the signals received from said first, second, fourth, and fifth sensors and outputs a tipping moment signal based on said determined suspension load and the thus calculated operating radii.

21. A mobile crane in accordance with claim 20, wherein said controller is equipped with a correction processing unit for calculating a deflection amount of said first boom and for correcting said operating radii by said deflection amount, and wherein said tipping moment signal is based on said determined suspension load and the thus corrected operating radii.

22. A mobile crane in accordance with claim 20, wherein said controller is equipped with a correction processing unit for calculating a deflection amount of said first boom and a deflection amount of said second boom and for correcting said operating radii by said deflection amounts, and wherein said tipping moment signal is based on said determined suspension load and the thus corrected operating radii.

23. A mobile crane in accordance with claim 22, wherein said controller provides a reference load, compares each of said first and second calculated suspension loads with said reference load, and automatically stops an operation of said crane when either of said first and second calculated suspension loads exceeds said reference load.

24. A mobile crane in accordance with claim 23, wherein said controller determines said reference load from said tipping moment signal.

25. A mobile crane in accordance with claim 7, wherein said controller provides a reference load, compares each of said first and second calculated suspension loads with said reference load, and automatically stops an operation of said crane when either of said first and second calculated suspension loads exceeds said reference load.

26. A mobile crane in accordance with claim 7, wherein each of said first and second booms is a telescoping boom.

* * * * *